US006506220B2

(12) United States Patent
Clark et al.

(10) Patent No.: US 6,506,220 B2
(45) Date of Patent: Jan. 14, 2003

(54) TREATMENT FOR FABRICS

(75) Inventors: Judith Mary Clark, Nottingham (GB); Andrew Hopkinson, Bebington (GB); Christopher Clarkson Jones, Bebington (GB); Jonathan Frank Warr, Kingston-upon-Thames (GB); Henri Chanzy, La Tronche (FR); Claire David, Saint Cyr sur Loire (FR); Etienne Fleury, Irigny (FR); Daniel Joubert, Vineuil Saint Firmin (FR); Christine Lancelon-Pin, Seyssinet (FR)

(73) Assignee: Unilever Home & Personal Care USA division of Conopco, Greenwich, CT (US)

( * ) Notice: Subject to any disclaimer, the term of this patent is extended or adjusted under 35 U.S.C. 154(b) by 0 days.

(21) Appl. No.: 09/827,390

(22) Filed: Apr. 5, 2001

(65) Prior Publication Data

US 2002/0052302 A1 May 2, 2002

Related U.S. Application Data

(62) Division of application No. 09/409,170, filed on Sep. 30, 1999, now Pat. No. 6,288,022.

(30) Foreign Application Priority Data

Sep. 30, 1998 (GB) ..... 9821214
Oct. 9, 1998 (FR) ..... 9812681

(51) Int. Cl.[7] ..... D06M 15/11
(52) U.S. Cl. ..... 8/115.51; 510/470; 510/473
(58) Field of Search ..... 510/470, 473; 8/115.51

(56) References Cited

U.S. PATENT DOCUMENTS

| | | | | |
|---|---|---|---|---|
| 4,235,735 A | | 11/1980 | Harris et al. | |
| 4,304,564 A | * | 12/1981 | Frick, Jr. et al. | 8/194 |
| 5,872,111 A | * | 2/1999 | Au et al. | 514/62 |

FOREIGN PATENT DOCUMENTS

| | | | |
|---|---|---|---|
| DE | 3227267 A | * | 2/1983 |
| EP | 0 025 255 | | 3/1981 |
| EP | 0 084 772 | | 8/1983 |
| EP | 0 266 324 | | 10/1986 |
| GB | 1041020 | | 9/1966 |
| GB | 2219587 A | * | 12/1989 |
| JP | 61-225389 | * | 10/1986 |
| WO | 91/16359 | | 10/1991 |
| WO | 98/00500 | | 1/1998 |
| WO | 98/29528 | | 7/1998 |
| WO | 99/14245 | | 3/1999 |
| WO | 99/14295 | | 3/1999 |

OTHER PUBLICATIONS

Database WPI, Week 198707, Derwent Abstract XP002129432 of JP 62001697—1 p.
International Search Report PCT/EP 99/07422, dts. Feb. 15, 2000—4 pp.

* cited by examiner

*Primary Examiner*—John Hardee
(74) *Attorney, Agent, or Firm*—Alan A. Bornstein

(57) ABSTRACT

Laundry treatment compositions, especially detergent compositions or rinse conditioners, which deposit cellulosic polymers or related polysaccharide fabric rebuild agents onto textile fabrics are described. Such agents are used for laundering cellulosic fabrics such as cotton, to compensate for gradual loss of fibrous material on repeated washing. Preferred rebuild agents are cellulose monoacetate, cellulose hemisuccinate and other cellulose esters.

43 Claims, No Drawings

TREATMENT FOR FABRICS

TECHNICAL FIELD

This application is a division of Ser. No. 09/409,170, Sep. 9, 1999, now U.S. Pat. No. 6,288,022.

The present invention relates to an ingredient for laundry cleaning or treatment products, for deposition onto fabric during a washing, rinsing or other treatment process. It further extends to compositions containing such an ingredient and methods of fabrics treatment using these compositions.

BACKGROUND OF THE INVENTION

Repeated washing of garments, particularly those comprising cotton or other cellulosic fibres, causes gradual loss of material from individual fibres and the loss of whole fibres from the fabric. These processes of attrition result in thinning of the fabric, eventually rendering it semi-transparent, more prone to accidental tearing and generally detracting from its original appearance.

Hitherto, there has been no way of minimising this kind of damage except by employing less frequent washing and use of less harsh detergent products and/or wash conditions, which obviously tends to less effective cleaning.

In laundry cleaning or treatment products, it is essential for some ingredients to be deposited onto and adhere to the fabric for them to deliver their beneficial effects. Typical examples are fabric conditioners or softeners. Nevertheless, the benefits conferred by such conventional materials do not include rebuilding the fabric.

It has now been found possible to include in laundry products, agents which deposit cellulose or cellulose-like materials onto the fabric to at least partially replace the lost material of the fibre.

EP-A-0 084 772 discloses a graft polymer dispersion comprising a vinyl-containing organopolysiloxane, an organopolysiloxane with unsubstituted silicon atom and polymerised units of vinyl monomers. Aqueous emulsions of these materials are used as water repellents to be applied to textiles during manufacture, whilst also endowing a softening and smoothing effect. Unlike conventional silicones they are said to offer the advantage of retaining elasticity and "recovery" of the weave. There is also a disclosure of strengthening of textiles during manufacture by application of acrylates, polyacrylates and polymetacrylates. However, there is nothing in this reference to suggest use of a material during a laundry process, for rebuilding the material of the fabric.

EP-A-0 025 255 discloses laundry wash or softening agents and shampoo compositions, containing a complex of an arylamine and a fatty acid or phosphate ester. The heat of the wash/rinse water softens the solid particles of this material to enhance its deposition. However, again, there is no suggestion of this agent being able to rebuild cellulose-type fibres.

EP-A-0 266 324 discloses fabric conditioners which are amine-anionic surfactant ion pair complexes. Thus, these are not polymeric, nor do they aid fabric rebuild.

WO-A-98/00500 discloses detergent compositions comprising a peptide or protein deposition aid having a high affinity for fibres or a surface, and having a benefit agent attached/absorbed to the deposition aid. There is no disclosure of use for these materials as fabric rebuild agents. Moreover, the peptide/protein material is significantly more costly than the polysaccharides used in the present invention.

WO-A-98/29528 discloses cellulose ethers in which some substituents are (poly)alkoxylated, analogues of the latter in which the (poly)alkoxylated groups are terminated with a cationic moiety in the form of a quaternary ammonium group, and cellulose ethers in which some substituents are carboxylic acids in the salt form (i.e. the materials are essentially carboxymethylcellulose variants). None of these substituents in any variant is of a kind which would undergo a chemical change to enhance fabric WO-A-99/14245 discloses laundry detergent compositions containing cellulosic based polymers to provide appearance and integrity benefits to fabrics. These polymers are cellulosic polymers in which the saccharide rings have pendant oxygen atoms to which substituents 'R' are bonded, i.e. they are attached to the rings via an ether linkage. The groups 'R' can be hydrogen, lower alkyl or alkylene linkages terminated by carboxylic acid, ester or amide groups. Optionally, up to five alkyleneoxy groups may be interspersed between the groups are the respective oxygen atom. At least some of these groups may undergo a chemical change such as hydrolysis, in the wash liquor. However no such change would result in an increased affinity for the fabric. On the contrary, because the "ester" group is configured with the carbonyl group closer to the polysaccharide than the oxygen atom (i.e. esters of carboxyalkyl groups), any hydrolysis will result in free acid substituents which will actually result in an increase in solubility and therefore, a decrease in affinity for the-fabric.

WO-A-99/14295 discloses structures analogous to those described in WO-A-99/14245 but in one alternative, the substituents 'R' together with the oxygen on the saccharide ring, constitute pendant half-esters of certain dicarboxylic acids. A single example of such a material is given. The dicarboxylic acid half-esters would tend to hydrolyse in the wash liquor and thereby increase affinity of the material for a cotton fabric. However, first, this mechanism of action or behaviour is not mentioned. Second, the hydrolysis rate of such dicarboxylic acids half esters is not as great as that of esters of monocarboxylic acids (which are not disclosed or claimed in WO-A-99/14295). Third, the degree of substitution for this variant is specified as being from 0.001 to 0.1. This is so low as to make the enhancement of fabric affinity too low to be worthwhile for this mechanism of action. Fourth, the structures described and claimed insofar as they have such half ester substituents, must also have substituents of the type which are carboxyalkyl groups or esters thereof, i.e. of the type also described in WO-A-99/14245. In the latter (ester) case, these would hydrolyse to the free acid form. The degree of substitution of the latter (0.2 to 2) is considerably higher than for the half-ester groups and the resultant increase in solubility would easily negate any enhanced affinity for the fabric by hydrolysis of the half-ester groups.

Definition of the Invention

Thus, a first aspect of the present invention now provides a laundry treatment composition comprising a water-soluble or water-dispersible rebuild agent for deposition onto a fabric during a treatment process wherein the rebuild agent undergoes during the treatment process, a chemical change by which change the affinity of the rebuild agent for the fabric is increased, said chemical change resulting in the loss or modification of one or more groups covalently bonded to be pendant to a polymeric backbone of the rebuild agent via an ester linkage, the ester-linked group(s) being selected from monocarboxylic acid esters.

In compositions according to the first aspect of the invention, the polymeric backbone of the rebuild agent preferably comprises cellulose units or other β-1,4 linked polysaccharide units. Moreover, the average degree of substitution of all pendant group(s), i.e. all the group(s) which undergo the chemical change plus any other groups per saccharide rings for the totality of saccharide rings in the rebuild agent is preferably from 0.3 to 3, more preferably from 0.4 to 1, still more preferably from 0.5 to 0.75 and most preferably from 0.6 to 0.7.

Throughout this specification, "average degree of substitution" refers to the number of substituted pendant groups per saccharide ring, averaged over all saccharide rings of the rebuild agent. Each saccharide ring prior to substitution has three —OH groups and therefore, an average degree of substitution of 3 means that each of these groups on all molecules of the sample, bears a substituent.

By ester linkage is meant that the hydrogen of an —OH group has been replaced by a substituent such as R'—CO—, $R'SO_2$— etc to form a carboxylic acid ester, sulphonic acid ester (as appropriate) etc together with the remnant oxygen attached to the saccharide ring. In some cases, the group R' may for example contain a heteroatom, e.g. as an —NH— group, attached to the carbonyl, sulphonyl etc group, so that the linkage as a whole could be regarded as a urethane etc linkage. However, the term ester linkage is still to be construed as encompassing these structures. The compositions according to the second aspect are not limited to those incorporating rebuild agents incorporating monocarboxylic acid ester linkages.

A second aspect of the present invention provides a laundry treatment composition comprising a water-soluble or water-dispersible rebuild agent for deposition onto a fabric during a treatment process wherein the rebuild agent undergoes during the treatment process, a chemical change by which change the affinity of the rebuild agent for the fabric is increased, wherein the chemical change occurring in or to a group or groups covalently bonded to be pendant on a polymeric backbone of the rebuild agent and which backbone comprises cellulose units or other β-1,4 linked polysaccharide units, the average degree of substitution of the total of all group(s) pendant on the saccharide rings of the backbone being from 0.4 to 3, preferably from 0.4 to 1, more preferably from 0.5 to 0.75, most preferably from 0.6 to 0.7.

Optionally, compositions may embody both the first and second aspects of the inventions, simultaneously.

A third aspect of the present invention provides a method of reducing thinning of a fabric due to washing, the process comprising treating the fabric with a laundry treatment composition according to the first and/or second aspect of the present invention.

Some, but not all, materials useful as rebuild agents in the composition of the first and second aspects of the invention are novel per se. Thus, a fourth aspect of the present invention provides novel such materials as defined further, hereinbelow.

The exact mechanism by which any of these rebuild agents exert there effect is not fully understood. Whether or not they can repair thinned or damaged fibres is not known. However, they are capable of replacing lost fibre weight with deposited and/or bonded material, usually of cellulosic type. This can provide one or more advantages such as repair or rebuilding of the fabric, strengthening of the textile or giving it enhanced body or smoothness, reducing its transparency, reducing fading of colours, improving the appearance of the fabric or of individual fibres, improved comfort during garment wear, dye transfer inhibition, increased stiffness, anti-wrinkle, effect and ease of ironing.

In the case of those rebuild agents having a cellulose backbone and pendant ester groups, without being bound by any particular theory or explanation, the inventors have conjectured that the mechanism of deposition is as follows.

Cellulose is substantially insoluble in water. Attachment of the ester groups causes disruption of the hydrogen bonding between rings of the cellulose chain, thus increasing water solubility or dispersibility. In the treatment liquor, it is believed that the ester groups are hydrolysed, causing the affinity for the fabric to increase and the polymer to be deposited on the fabric.

Detailed Description of the Invention

The Rebuild Agent

The rebuild agent material of the present invention is water-soluble or water-dispersible in nature and in a preferred form, comprises a polymeric backbone having one or more pendant groups which undergo the chemical change to cause an increase in affinity for fabric.

The weight average molecular weight ($M_w$) of the rebuild agent (as determined by GPC) may typically be in the range of 500 to 2,000,000 for example 1,000 to 1.500,000. Preferably though, it is from 1,000 to 100,000, more preferably from 5.000 to 50,000. especially from 10,000 to 15,000.

By water-soluble, as used herein, what is meant is that the material forms an isotropic solution on addition to water or another aqueous solution.

By water-dispersible, as used herein, what is meant is that the material forms a finely divided suspension on addition to water or another aqueous solution. Preferably though, the term "water-dispersible" means that the material, in water at pH 7 and at 25° C., produces a solution or a dispersion having long-term stability.

By an increase in the affinity of the material for the fabric upon a chemical change, what is meant is that at some time during the treatment process, the amount of material that has been deposited is greater when the chemical change is occurring or has occurred, compared to when the chemical change has not occurred and is not occurring, or is occurring more slowly, the comparison being made with all conditions being equal except for that change in the conditions which is necessary to affect the rate of chemical change.

Deposition includes adsorption, cocrystallisation, entrapment and/or adhesion.

The Polymeric Backbone

For the first aspect of the invention, it is especially preferred that the polymeric backbone is of a similar chemical structure to that of at least some of the fibres of the fabric onto which it is to be deposited.

For example, if the fabric is cellulosic in nature, e.g. cotton, the polymeric backbone is preferably cellulose or a cellulose derivative or a another β-1,4-linked polysaccharide having an affinity for cellulose, such as mannan and glucomannan. This is essential in the case of the second aspect of the invention. The average degree of substitution on the polysaccharide of the pendant groups which undergo the chemical change (plus any non-functional pendant groups which may be present) is preferably (for compositions according to the first aspect of the invention) or essential (for compositions according to the second aspect of the invention) from 0.3 to 3, more preferably from 0.4 to 1. Still more preferred is a degree of substitution of from 0.5 to 0.75 and yet more preferred is 0.6–0.7.

The polysaccharide may be straight or branched. Many naturally occurring polysaccharides have at least some degree of branching, or at any rate, at least some saccharide rings are in the form of pendant side groups (and therefore are not in themselves counted in the degree of substitution) on a main polysaccharide backbone.

A polysaccharide comprises a plurality of saccharide rings which have pendant hydroxyl groups. The pendant groups can be bonded chemically or by other bonding mechanism, to these hydroxyl groups by any means described hereinbelow. The "average degree of substitution" means the average number of pendant groups per saccharide ring for the totality of polysaccharide molecules in the sample and is determined for all saccharide rings whether they form part of a linear backbone or are themselves, pendant side groups in the polysaccharide.

Other polymeric backbones suitable as according to the present invention include those described in Hydrocolloid Applications, A. Nussinswitch, Blackie 1997.

Pendant Groups Which Undergo the Chemical Change

In the case of the first aspect of the invention, the chemical change which causes the increased fabric affinity will usually be hydrolysis. In the case of the second aspect of the invention it is preferably lysis, for example hydrolysis or, perhydrolysis or else it is preferably bond-cleavage, optionally catalysed by an enzyme or another catalyst. Hydrolysis of ester-linked groups is most typical. However, preferably this change is not merely protonation or deprotonation, i.e. a pH induced effect.

The chemical change occurs in or to a group covalently bonded to a polymeric backbone, especially, the loss of one or more such groups. These group(s) is/are pendant on the backbone. In the case of the first aspect of the invention these are ester-linked groups based on monocarboxylic acids.

Preferred for use in the first aspect of the invention are cellulosic polymers of formula (I):

(I)

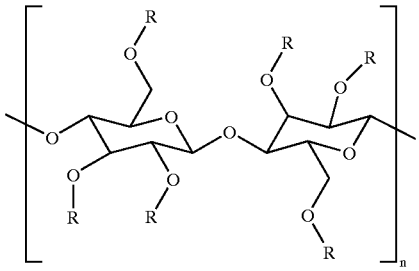

wherein at least one or more R groups of the polymer are independently selected from groups of formulae:

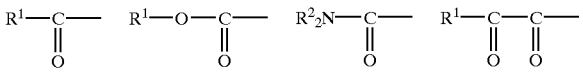

wherein each $R^1$ is independently selected from $C_{1-20}$ (preferably $C_{1-6}$)alkyl, $C_{2-20}$ (preferably $C_{2-6}$) alkenyl (e.g. vinyl) and $C_{5-7}$ aryl (e.g. phenyl) any of which is optionally substituted by one or more substituents independently selected from $C_{1-4}$ alkyl, $C_{1-2}$ (preferably $C_{1-4}$) alkoxy, hydroxyl, vinyl and phenyl groups; and each $R^2$ is independently hydrogen or a group $R^1$ as hereinbefore defined.

The second aspect of the invention is not limited to (but may include) use of rebuild agents incorporating ester linkages based on inonocarboxylic acids. Mono-, di- and polycarboxylic ester- or semi-ester-linkages, ester and semi-ester linkages derived from non-carboxylic acids, as well as carbamate, urea or silyl linked groups, as well as others, are also possible.

However, preferred for use in the second aspect of the invention are cellulosic polymers of formula (II):

(II)

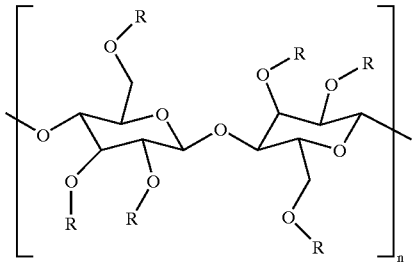

wherein at least one or more R groups of the polymer are independently selected from groups of formulae:

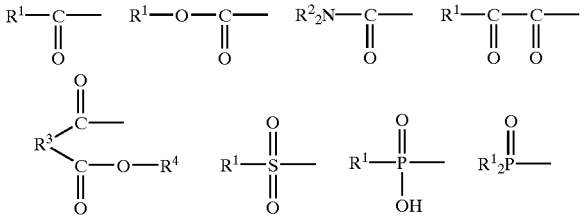

wherein each $R^1$ is independently selected from $C_{1-20}$ (preferably $C_{1-6}$) alkyl, $C_{2-20}$ (preferably $C_{2-6}$) alkenyl (e.g. vinyl) and $C_{5-7}$ aryl (e.g. phenyl) any of which is optionally substituted by one or more substituents independently selected from $C_{1-4}$ alkyl, $C_{1-12}$ (preferably $C_{1-4}$) alkoxy, hydroxyl, vinyl and phenyl groups;

each $R^2$ is independently selected from hydrogen and groups $R^1$ as hereinbefore defined;

$R^3$ is a bond or is selected from $C_{1-4}$ alkylene, $C_{2-4}$ alkenylene and $C_{5-7}$ arylene (e.g. phenylene) groups, the carbon atoms in any of these being optionally substituted by one or more substituents independently selected from $C_{1-12}$ (preferably $C_{1-4}$) alkoxy, vinyl, hydroxyl, halo and amine groups;

each $R^4$ is independently selected from hydrogen, counter cations such as alkali metal (preferably Na) or $_2{}^1$Ca or $_2{}^1$Mg, and groups $R^1$ as hereinbefore defined; and groups R which together with the oxygen atom forming the linkage to the respective saccharide ring forms an ester or hemi-ester group of a tricarboxylic- or higher polycarboxylic- or other complex acid such as citric acid, an amino acid, a synthetic amino acid analogue or a protein.

For the avoidance of doubt, as already mentioned, in both formula (I) and formula (II) some of the R groups may optionally have one or more structures, for example as hereinbefore described. For example, one or more R groups may simply be hydrogen or an alkyl group.

In the case of formula (II), some preferred R groups may be independently selected from one or more of methanesulphonate, toluene, sulphonate, groups and hemiester groups of fumaric, malonic, itaconic, oxalic, maleic, succinic, tartaric, glutamic, aspartic and malic acids.

In the case of formula (I) and formula (II), they may be independently selected from one or more of acetate, propanoate, trifluroacetate, 2-(2-hydroxy-1-oxopropoxy) propanoate, lactate, glycolate, pyruvate, crotonate, isovalerate, cinnamate, formate, salicylate, carbamate, methylcarbamate, benzoate and gluconate groups.

Particularly preferred are cellulose monoacetate, cellulose hemisuccinate, and cellulose 2-(2-hydroxy-1-oxopropoxy) propanoate. The term "cellulose monoacetate" is used herein to denote those acetates with the degree of substitution of 1 or less.

Other Pendant Groups

As mentioned above, preferred (for the first aspect of the invention) or essential (for the second aspect of the invention) are degrees of substitution for the totality of all pendant substituents in the following order of increasing preference: from 0.3 to 3, from 0.4 to 1, from 0.5 to 0.75, from 0.6 to 0.7. However, as well as the groups which undergo the chemical change, pendant groups of other types may optionally be present, i.e. groups which do not undergo a chemical change to enhance fabric affinity. Within that class of other groups is the sub-class of groups for enhancing the solubility of the rebuild agent (e.g. groups which are, or contain one or more free carboxylic acid/salt and/or sulphonic acid/salt and/or sulphate groups).

Examples of solubility enhancing substituents include carboxyl, sulphonyl, hydroxyl, (poly)ethyleneoxy-and/or (poly)propyleneoxy-containing groups, as well as amine groups.

The other pendant groups preferably constitute from 0% to 65%, more preferably from 0% to 10% (e.g. from 0% to 5%) of the total number of pendant groups. The minimum number of other pendant groups may, for example be 0.1% or 1% of the total. The water-solubilising groups could comprise from 0% to 100% of those other groups but preferably from 0% to 20%, more preferably from 0% to 10%, still more preferably from 0% to 5% of the total number of other pendant groups.

Synthetic Routes

Those rebuild agents according to the present invention which are not commercially available may be prepared by a number of different synthetic routes, for example:

(1) polymerisation of suitable monomers, for example, enzymatic polymerisation of saccharides, e.g. per S. Shoda, & S. Kobayashi, Makromol. Symp. 1995, 99, 179–184 or oligosaccharide synthesis by orthogonal glycosylation e.g. per H. Paulsen, Angew. Chem. Int. Ed. Engl. 1995, 34, 1432–1434.;

(2) derivatisation of a polymeric backbone (either naturally occurring, especially polysaccharides, especially beta-1,4-linked polysaccharides, especially cellulose, mannan, glucomannan, galactomannan, xyloglucan; or synthetic polymers) up to the required degree of substitution with functional groups which improve the solubility of the polymer using a reagent (especially acid halides, especially carboxylic acid halides, anhydrides, carboxylic acid anhydrides, carboxylic acids or, carbonates) in a solvent which either dissolves the backbone, swells the backbone, or does not swell the backbone but dissolves or swells the product;

(3) hydrolysis of polymer derivatives (especially esters) down to the required degree of substitution; or (4) a combination of any two or more of routes (1)–(3).

The degree and pattern of substitution from routes (1) or (2) may be subsequently altered by partial removal of functional groups by hydrolysis or solvolysis or other cleavage. Relative amounts of reactants and reaction times can also be used to control the degree of substitution. In addition, or alternatively, the degree of polymerisation of the backbone may be reduced before, during, or after the derivatisation with functional groups. The degree of polymerisation of the backbone may be increased by further polymerisation or by cross linking agents before, during, or after the derivatisation step.

Cellulose esters of hydroxyacids can be obtained using the acid anhydride, typically in acetic acid solution at 20–30° C. When the product has dissolved the liquid is poured into water. Glycollic and lactic esters can be made in this way.

Cellulose glycollate may also be obtained from cellulose chloracetate (B.P. 320,842) by treating 100 parts with 32 parts of NaOH in alcohol added in small portions.

An alternative method of preparing cellulose esters consists in the partial displacement of the acid radical in a cellulose ester by treatment with another acid of higher ionisation constant (F.P. 702,116). The ester is heated at about 100° with the acid which, preferably, should be a solvent for the ester. By this means cellulose acetate-oxalate, tartrate, maleate, pyruvate, salicylate and phenylglycollate have been obtained, and from cellulose tribenzoate a cellulose benzoate-pyruvate. A cellulose acetate-lactate or acetate-glycollate could be made in this way also. As an example cellulose acetate (10 g) in dioxan (75 ml) containing oxalic acid (10 g) is heated at 100° for 2 hours under reflux.

Multiple esters are prepared by variations of this process. A simple ester of cellulose, e.g. the acetate, is dissolved in a mixture of two (or three) organic acids, each of which has an ionisation constant greater than that of acetic acid ($1.82\times 10^{-5}$). With solid acids suitable solvents such as propionic acid, dioxan and ethylene dichloride are used. If a mixed cellulose ester is treated with an acid this should have an ionisation constant greater than that of either of the acids already in combination. Thus:

A cellulose acetate-lactate-pyruvate is prepared from cellulose acetate, 40 per cent acetyl (100 g), in a bath of 125 ml pyruvic acid and 125 ml of 85 per cent. lactic acid by eating at 100° for 18 hours. The product is soluble in water and is precipitated and ashed with ether-acetone. M.p. 230–250°.

Compositions

The rebuild agent may be incorporated into compositions containing only a diluent and/or also comprising another active ingredient. The compound is typically included in said compositions at levels of from 0.005% to 25% by weight, preferably 0.01% to 10%, most preferably 0.025% to 2.5%.

The component(s) of the composition should be such that when in use, e.g. when dissolved or dispersed in the wash or rinse liquor, deposition of the rebuild agent can occur. Most, if not all, conventional laundry wash and/or rinse compositions already fulfil this requirement. However, to assist such deposition, one may include at least one water-soluble additive capble of inducing or assisting the said deposition of the rebuild agent.

The optional water soluble additive(s) is/are selected e.g. from those which, in the washing or rinsing solution, have an anion capable of decomposing and a cation capable of forming a soluble salt with the anion originating from the substituent or substituents. In the case of rebuild agents which are water-dispersible cellulose esters, the said deposition additives can be in particular water-soluble, alkaline, de-esterifying additives, for example the carbonates, hydrogen carbonates, oxalates, tartrates, etc. of alkali metals, in particular sodium.

The water-soluble additive, capable of inducing, in the washing or rinsing medium, the deposition rebuild agent, is present in the said composition in an amount at least sufficient to induce chemical change in all groups provided for this prupose. In the case of a water-dispersible esterified cellulose, the alkaline de-esterifying additive is present in the said composition in an amount at least sufficient to de-esterify the said water-soluble esterified cellulose. This amount is preferably at least 5 times, preferably at least 10 times the stoichiometric amount necessary for complete de-esterification of the ester. It is generally less than 100 times the necessary stoichiometric amount.

The other active ingredient (if present) in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or (especially aqueous) liquid. In particular the compositions may be used in laundry compositions, especially in liquid or powder laundry composition, for example for use in a wash and/or rinse and/or drying process.

The compositions of the present invention are preferably laundry compositions, especially main wash (fabric washing) compositions or rinse-added softening compositions. The main wash compositions may include a fabric softening agent and rinse-added fabric softening compositions may include surface-active compounds, particularly non-ionic surface-active compounds, if appropriate.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may additionally or alternatively contain one or more other anionic surfactants in total amounts corresponding to percentages quoted above for alkyl benzene sulphonates. Suitable anionic surfactants are well-known to those skilled in the art. These include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Some particular examples of such other anionic surfactants are:

- alkyl ester sulphonates of the formula R—CH($SO_3$M)—COOR', where R is a $C_8$–$C_{20}$, preferably $C_{10}$–$C_{16}$ alkyl radical, R' is a $C_1$–$C_6$, preferably $C_1$–$C_3$ alkyl radical, and M is an alkaline cation (sodium, potassium, lithium), substituted or non-substituted ammonium (methyl, dimethyl, trimethyl, tetramethyl ammonium, dimethyl piperidinium, etc.) or a derivative of an alkanol amine (monoethanol amine, diethanol amine, triethanol amine, etc.);
- alkyl sulphates of the formula R$OSO_3$M, where R is a $C_5$–$C_{24}$, preferably $C_{10}$–$C_{18}$ alkyl or hydroxyalkyl radical, and M is a hydrogen atom or a cation as defined above, and their ethyleneoxy (EO) and/or propyleneoxy (PO) derivatives, having on average 0.5 to 30, preferably 0.5 to 10 EO and/or PO units;
- alkyl amide sulphates of the formula RCONHR'$OSO_3$M, where R is a $C_2$–$C_{22}$, preferably $C_6$–$C_{20}$ alkyl radical, R' is a $C_2$–$C_3$ alkyl radical, and M is a hydrogen atom or a cation as defined above, and their ethyleneoxy (EO) and/or propyleneoxy (PO) derivatives, having on average 0.5 to 60 EO and/or PO units;
- the salts of $C_8$–$C_{24}$, preferably $C_{14}$–$C_{20}$ saturated or unsaturated fatty acids, $C_8$–$C_{22}$ primary or secondary alkyl sulphonates, alkyl glycerol sulphonates, the sulphonated polycarboxylic acids described in GB-A-1 082 179, paraffin sulphonates, N-acyl,N'-alkyl taurates, alkyl phosphates, isethionates, alkyl succinamates, alkyl sulphosuccinates, monoesters or diesters of sulphosuccinates, N-acyl sarcosinates, alkyl glycoside sulphates, polyethoxycarboxylates, the cation being an alkali metal (sodium, potassium, lithium), a substituted or non-substituted ammonium residue (methyl, dimethyl, trimethyl, tetramethyl ammonium, dimethyl piperidinium, etc.) or a derivative of an alkanol amine (monoethanol amine, diethanol amine, triethanol amine, etc.);
- sophorolipids, such as those in acid or lactone form, derived from 17-hydroxyoctadecenic acid;

The compositions of the invention may contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Some particular examples of such nonionic surfactants are:

- polyalkoxylenated alkyl phenols (i.e. polyethyleneoxy, polypropyleneoxy, polybutyleneoxy), the alkyl substituent of which has from 6 to 12 C atoms and contains from 5 to 25 alkoxylenated units; examples are TRITON X-45, X-114, X-100 and X-102 marketed by Rohm & Haas Co., IGEPAL NP2 to NP17 made by RHÔNE-POULENC;
- $C_8$–$C_{22}$ polyalkoxylenated aliphatic alcohols containing 1 to 25 alkoxylenated (ethyleneoxy, propyleneoxy) units; examples are TERGITOL 15-S-9, TERGITOL 24-L-6 NMW marketed by Union Carbide Corp., NEODOL 45-9, NEODOL 23–65, NEODOL 45-7, NEODOL 45-4 marketed by Shell Chemical Co., KYRO EOB marketed by The Procter & Gamble Co., SYNPERONIC A3 to A9 made by ICI, RHODASURF IT, DB and B made by RHÔNE-POULENC;
- the products resulting from the condensation of ethylene oxide or propylene oxide with propylene glycol, ethylene glycol, with a molecular weight in the order of 2000 to 10,000, such as the PLURONIC products marketed by BASF;
- the products resulting from the condensation of ethylene oxide or propylene oxide with ethylene diamine, such as the TETRONIC products marketed by BASF;
- $C_8$–$C_{18}$ ethoxyl and/or propoxyl fatty acids containing 5 to 25 ethyleneoxy and/or propyleneoxy units;
- $C_8$–$C_{20}$ fatty acid amides containing 5 to 30 ethyleneoxy units;
- ethoxylated amines containing 5 to 30 ethyleneoxy units;
- alkoxylated amidoamines containing 1 to 50, preferably 1 to 25 and in particular 2 to 20 alkyleneoxy (preferably ethyleneoxy) units;

amine oxides such as the oxides of alkyl $C_{10}$–$C_{18}$ dimethylamines, the oxides of alkoxy $C_8$–$C_{22}$ ethyl dihydroxy ethylamines;

alkoxylated terpene hydrocarbons such as ethoxylated and/or propoxylated a- or b-pinenes, containing 1 to 30 ethyleneoxy and/or propyleneoxy units;

alkylpolyglycosides obtainable by condensation (for example by acid catalysis) of glucose with primary fatty alcohols (e.g. U.S. Pat. Nos. 3,598,865; 4,565,647; EP-A-132 043; EP-A-132 046) having a $C_4$–$C_{20}$, preferably $C_8$–$C_{18}$ alkyl group and an average number of glucose units in the order of 0.5 to 3, preferably in the order of 1.1 to 1.8 per mole of alkylpolyglycoside (APG), particularly those having

- a $C_8$–$C_{14}$ alkyl group and on average 1.4 glucose units per mole
- a $C_{12}$–$C_{14}$ alkyl group and on average 1.4 glucose units per mole
- a $C_8$–$C_{14}$ alkyl group and on average 1.5 glucose units per mole
- a $C_8$–$C_{10}$ alkyl group and on average 1.6 glucose units per mole marketed under the names GLUCOPON 600 EC®, GLUCOPON 600 CSUP®, GLUCOPON 650 EC® and GLUCOPON 225 CSUP® respectively and made by HENKEL;

It is preferred if the level of total non-ionic surfactant is from 0 wt % to 30 wt %, preferably from 1 wt % to 25 wt %, most preferably from 2 wt % to 15 wt %.

Another class of suitable surfactants comprises certain mono-alkyl cationic surfactants useful in main-wash laundry compositions. Cationic surfactants that may be used include quaternary ammonium salts of the general formula $R_1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use in most automatic fabric washing machines generally contain anionic non-soap surfactant, or non-ionic surfactant, or combinations of the two in any suitable ratio; optionally together with soap.

Any conventional fabric conditioning agent may be used in the compositions of the present invention. The conditioning agents may be cationic or non-ionic. If the fabric conditioning compound is to be employed in a main wash detergent composition the compound will typically be non-ionic. If used in the rinse phase, they will typically be cationic. They may for example be used in amounts from 0.5% to 35%, preferably from 1% to 30% more preferably from 3% to 25% by weight of the composition.

Preferably the fabric conditioning agent has two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric conditioning agents are predominantly linear.

The fabric conditioning agents are preferably compounds that provide excellent softening, and are characterised by a chain melting $L\beta$ to $L\alpha$ transition temperature greater than 25° C., preferably greater than 35° C., most preferably greater than 45° C. This $L\beta$ to $L\alpha$ transition can be measured by DSC as defined in "Handbook of Lipid Bilayers, D Marsh, CRC Press, Boca Raton, Fla., 1990 (pages 137 and 337).

Substantially insoluble fabric conditioning compounds in the context of this invention are defined as fabric conditioning compounds having a solubility less than $1\times10^{-3}$ wt % in demineralised water at 20° C. Preferably the fabric softening compounds have a solubility less than $1\times10^{-1}$ wt %, most preferably less than $1\times10^{-8}$ to $1\times10^{-6}$. Preferred cationic fabric softening agents comprise a substantially water insoluble quaternary ammonium material comprising a single alkyl or alkenyl long chain having an average chain length greater than or equal to $C_{20}$ or, more preferably, a compound comprising a polar head group and two alkyl or alkenyl chains having an average chain length greater than or equal to $C_{14}$.

Preferably, the cationic fabric softening agent is a quaternary ammonium material or a quaternary ammonium material containing at least one ester group. The quaternary ammonium compounds containing at least one ester group are referred to herein as ester-linked quaternary ammonium compounds.

As used in the context of the quarternary ammonium catianic fabric softening agents, the term 'ester group', includes an ester group which is a linking group in the molecule.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester groups(s) are preferably attached to the nitrogen atom via another hydrocarbyl group.

Also preferred are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

Preferably the quaternary ammonium material is a compound having two $C_{12}$–$C_{22}$ alkyl or alkenyl groups connected to a quaternary ammonium head group via at least one ester link, preferably two ester links or a compound comprising a single long chain with an average chain length equal to or greater than $C_{20}$.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

The most preferred type of ester-linked quaternary ammonium material that can be used in compositions according to the invention is represented by the formula (A):

(A)

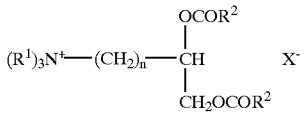

wherein $R^1$, n, $R^2$ and $X^-$ are as defined above.

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180. Preferably these materials comprise small amounts of the corresponding monoester as described in U.S. Pat. No. 4,137,180 for example 1-hardened tallowoyloxy-2-hydroxy-3-trimethylammonium propane chloride.

Another class of preferred ester-linked quaternary ammonium materials for use in compositions according to the invention can be represented by the formula:

(B)

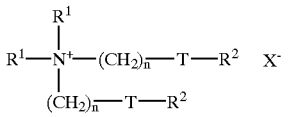

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; $X^-$ is any suitable counter-ion, i.e. a halide, acetate or lower alkosulphate ion, such as chloride or methosulphate.

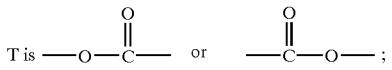

and n is an integer from 1–5 or is 0

It is especially preferred that each $R^1$ group is methyl and each n is 2.

Of the compounds of formula (B), Di-(tallowyloxyethyl)-dimethyl ammonium chloride, available from Hoechst, is the most preferred. Di-(hardened tallowyloxyethyl)dimethyl ammonium chloride, ex Hoechst and di-(tallowyloxyethyl)-methyl hydroxyethyl methosulphate are also preferred.

Another preferred class of quaternary ammonium cationic fabric softening agent is defined by formula (C):

(C)

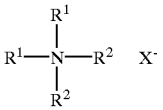

where $R^1$, $R^2$ and X are as hereinbefore defined.

A preferred material of formula (C) is di-hardened tallowdiethyl ammonium chloride, sold under the Trademark Arquad 2HT.

The optionally ester-linked quaternary ammonium material may contain optional additional components, as known in the art, in particular, low molecular weight solvents, for instance isopropanol and/or ethanol, and co-actives such as nonionic softeners, for example fatty acid or sorbitan esters.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defmed as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. Nos. 4,751,015 and 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. examples of such peracids can be found in U.S. Pat. Nos. 4,686,063 and 5,397,501 (Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (transistor metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A ,EP 458 398A and EP 509 787A (Unilever).

The compositions according to the invention may also contain one or more enzyme(s). Suitable enzymes include the proteases, amylases, cellulases, oxidases. peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. Subtilis B. licheniformis,* such as the commercially available subtilisins Maxatase (Trade Mark), as supplied by Gist Brocades N. V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate. in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; coloured speckles; perfumes; foam controllers; fluorescers and decoupling polymers. This list is not intended to be exhaustive.

It is often advantageous if soil release or soil suspendng polymers are present, for example in amounts in the order of 0.01% to 10%, preferably in the order of 0.1% to 5% and in particular in the order of 0.2% to 3% by weight, such as

- cellulose derivatives such as cellulose hydroxyethers, methyl cellulose, ethyl cellulose, hydroxypropyl methyl cellulose, hydroxybutyl methyl cellulose;
- polyvinyl esters grafted onto polyalkylene backbones, such as polyvinyl acetates grafted onto polyoxyethylene backbones (EP-A-219 048);

polyvinyl alcohols;

polyester copolymers based on ethylene terephthalate and/or propylene terephthalate units and polyethyleneoxy terephthalate units, with a molar ratio (number of units) of ethylene terephthalate and/or propylene terephthalate/(number of units) polyethyleneoxy terephthalate in the order of 1/10 to 10/1, the polyethyleneoxy terephthalate units having polyethyleneoxy units with a molecular weight in the order of 300 to 10,000, with a molecular weight of the copolyester in the order of 1000 to 100,000;

polyester copolymers based on ethylene terephthalate and/or propylene terephthalate units and polyethyleneoxy and/or polypropyleneoxy units, with a molar ratio (number of units) of ethylene terephthalate and/or propylene terephthalate/(number of units) polyethyleneoxy and/or polypropyleneoxy in the order of 1/10 to 10/1, the polyethyleneoxy and/or polypropyleneoxy units having a molecular weight in the order of 250 to 10,000, with a molecular weight of the copolyester in the order of 1000 to 100,000 (U.S. Pat. Nos. 3,959,230, 3,962,152, 3,893,929, 4,116,896, 4,702,857, 4,770, 666, EP-A-253 567, EP-A-201 124);

copolymers of ethylene or propylene terephthalate/polyethyleneoxy terephthalate comprising sulphoisophthaloyl units in their chain (U.S. Pat. Nos. 4,711,730, 4,702,857, 4,713,194);

terephthalic copolyester oligomers having polyalkyleneoxyalkyl sulphonate/sulphoaroyl terminal groups and optionally containing sulphoisophthaloyl units in their chain (U.S. Pat. Nos. 4,721,580, 5,415,807, 4,877, 896, 5,182,043, 5,599,782, 4,764,289, EP-A-311 342, W092/04433, W097/42293);

sulphonated terephthalic copolyesters with a molecular weight less than 20,000, obtained e.g. from a diester of terephthalic acid, isophthalic acid, a diester of sulphoisophthalic acid and a diol, in particular ethylene glycol (W095/32997);

polyurethane polyesters, obtained by reaction of a polyester with a molecular weight of 300 to 4000, obtained from a terephthalic acid diester, possibly a sulphoisophthalic acid diester and a diol, on a prepolymer with isocyanate terminal groups, obtained from a polyethyleneoxy glycol with a molecular weight of 600 to 4000 and a diisocyanate (U.S. Pat. No. 4,201,824);

sulphonated polyester oligomers obtained. by sulphonation of an oligomer derived from ethoxylated allyl alcohol, dimethyl terephthalate and 1,2-propylene diol. having 1 to 4 sulphonate groups (U.S. Pat. No. 4,968, 451);

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Any suitable method may be used to produce the compounds of the present invention.

Treatment Process

Treatment of the fabric with the rebuild agent can be made by any suitable method such as washing, soaking or rinsing of the substrate.

Typically the treatment will involve a washing or rinsing method such as treatment in the main wash or rinse cycle of a washing machine and involves contacting the fabric with an aqueous medium comprising the composition of the present invention.

The present invention will now be explained in more detail by way of the following non-limiting examples.

EXAMPLES

Example 1

Preparation of Cellulose "Monoacetate"

This was prepared by the methods of WO 91/16359.

Example 1a 30.0 g of cellulose diacetate (DS 2.45) (the starting cellulose ester), 0.08 g of molybdenum carbonyl (catalyst), 213.6 g of methanol (reactive solvent 1) and 30.0 g of water (reactive solvent 2) are loaded into a 1-liter, steel Parr reactor equipped with a magnetically coupled agitator. The reactor is sealed, then heated to 140° C. The heat-up time is typically 1 to 2 hours. The initial pressure in the reactor is typically 200–500 psi (1379–3447 kPa) nitrogen. The reaction mixture is stirred at 140° C. for 7 hours. Then the reaction mixture is allowed to cool to room temperature, which typically takes 2 to 3 hours. The products are isolated by filtration of the resulting slurry. The reactive solvent, as well as by-products such as methyl acetate, can be recovered from the filtrate by distillation. The product is cellulose monoacetate and the yield is 66%. The key analyses are: DS=0.48; intrinsic viscosity (0.25 g per 100 ml of DMSO)= 0.55.

Example 1b 30.0 g of cellulose diacetate (DS 2.45) (the starting cellulose ester), 0.05 g of molybdenum (VI) oxide and 237.3 g of methanol (reactive solvent) are loaded into a 1-liter, steel Parr reactor equipped with a magnetically coupled agitator. The reactor is sealed, then heated to 155° C. The heat-up time is typically 1 to 2 hours. The initial pressure in the reactor is typically 200–500 psi (1379–3447 kPa) nitrogen. The reaction mixture is stirred at 155° C. for 3 hours. Then the reaction mixture is allowed to cool to room temperature, which typically takes 2 to 3 hours. The products are isolated by filtration of the resulting slurry. The reactive solvent, as well as certain by-products such as methyl acetate ,can be recovered from the filtrate by distillation. The product is cellulose monoacetate and the yield is 87%. The key analyses are: DS=0.50; intrinsic viscosity (0.25 g per 100 ml of DMSO)=1.16.

Example 2

Preparation of Cellulose Hemisuccinate (First Route)

Cellulose hemisuccinate was prepared following B.P. 410,125. A mixture of cellulose (Whatman cellulose powder CF11 which is cotton, 5 g), succinic anhydride (25 g), and pyridine (75 ml) was kept at 65° C. for a week. On pouring into methanol the pyridinium salt of cellulose hemisuccinate was obtained. The crude cellulose hemisuccinate, pyridinium salt, was washed repeatedly with methanol to remove pyridine and unused reactants. The pyridinium salt of cellulose hemisuccinate was converted to the free acid form by driving off the pyridine under vacuum at <95° C.

Infrared spectra of reagents and products were recorded on a Bio-Rad FTS-7 infrared spectrometer using a Graseby Specac (Part #10500) Single Reflection Diamond ATR attachment.

The degree of substitution of cellulose hemisuccinate prepared from cotton fibres was determined by a one-step neutralisation of the carboxylic acid groups and hydrolysis of the ester groups, using an excess of sodium hydroxide, followed by titration of the excess sodium hydroxide with a standard solution of hydrochloric acid, using phenolphthalein as an indicator. The figure thus obtained was 2.8.

The infrared spectrum of the product in its neutralised, sodium salt form, has two distinct bands attributable to the stretching of C═O. The band at 1574 $cm^{-1}$ is attributable to carboxylate anion, a band for which is expected at 1550–1610 $cm^{-1}$. It is therefore reasonable to attribute the other band at 1727 $cm^{-1}$ to ester, a band for which is expected at 1735–1750 $cm^{-1}$. The infrared spectrum is therefore consistent with a hemiester salt.

Example 3

Preparation of Cellulose Hemisuccinate (Route 2)

Cellulose hemisuccinate was prepared following GB-A410,125. A mixture of cellulose (Avicel PH105, 5 g), succinic anhydride (25 g), and pyridine (75 ml) was kept at 65° C. for a week. On pouring into methanol the pyridinium salt of cellulose hemisuccinate was obtained. The crude cellulose hemisuccinate, pyridinium salt, was washed repeatedly with methanol to remove pyridine and unused reactants.

When this gel was mixed with dilute aqueous sodium hydroxide, it did not imnediately dissolve but remained as lumps, but it did slowly dissolve to form a near-optically-clear solution. The fact that the methanol-washed cellulose hemisuccinate was not immediately soluble in dilute aqueous sodium hydroxide indicated that the cellulose hemisuccinate was slightly cross linked.

The methanol-rinsed cellulose hemisuccinate was used to prepare a cellulose hemisuccinate having a lower degree of substitution and with fewer cross links which was water dispersable.

A homogeneous solution was prepared by partially hydrolysing the cellulose hemisuccinate as follows. Cellulose hemisuccinate prepared from microcrystalline cellulose, in the form of a gel of cellulose hemisuccinate, pyridinium salt, dispersed in methanol, was added to 50 ml of stirred 0.1 M NaCl solution at 50° C. 0.1 M NaOH solution was added until the pH was raised to ~7.0 (18.0 ml was required). More 0.1 M NaOH solution was added until the pH was raised to ~10.5 (3.0 ml was required). This pH was then maintained for 45 minutes by further additions of 0.1 M NaOH solution (4.2 ml was required). The mixture was then cooled to room temperature and neutralised using 1.0 M HCl (0.18 ml was required). After this procedure the solution was only slightly turbid. The polymer was separated from inorganic salts by ultrafiltration (Amicon, Inc.) employing a. cellulose triacetate membrane with a molecular weight cut-off of 10,000 (Sartorious SM 145 39).

The degree of substitution of cellulose hemisuccinate prepared from by this route was determined by a one-step neutralisation of the carboxylic acid groups and hydrolysis of the ester groups, using an excess of sodium hydroxide, followed by titration of the excess sodium hydroxide with a standard solution of hydrochloric acid, using phenolphthalein as an indicator. The figure thus obtained was 2.0.

Example 4

Preparation of Cellulose 2-(2-hydroxy-1-oxopropoxy) propanoate

Following the method described in DE 3,322,118 a mixture of 2.33 g lactide (3,6-dimethyl-1,4-dioxane-2,5-dione) and 29.7 g of cellulose solution (obtained by dissolving 14 g of microcrystalline cellulose (Avicel PH105) swollen with 14 g of N,N-dimethylacetamide in a mixture of 200 ml of N,N-diethylacetamide and 16.8 g of lithium chloride) was treated with 1.5 ml of triethyl amine and stirred at 75° C. for 1.5 hours.

Cellulose 2-(2-hydroxy-1-oxopropoxy)propanoate was isolated by pipetting the reaction mixture into 300 ml of methanol. The product gel was washed with a further two batches of 300 ml of methanol. At this stage the methanol-swollen 2-(2-hydroxy-1-oxopropoxy)propanoate was water soluble.

The cellulose 2-(2-hydroxy-1-oxopropoxy)propanoate was dried in a vacuum oven at room temperature. The dry cellulose 2-(2-hydroxy-1-oxopropoxy)propanoate was partially soluble.

Example 5

Preparation of a Cellulose Acetate Having a Degree of Substitution of 0.55

340 ml of acetic acid and 60 ml of water are heated to 80° C. in a reactor; 63 g of cellulose triacetate are dissolved in this acetic solution. The reaction medium is mixed with 140 ml of methanol.

The reaction mixture, placed in an inert atmosphere, is maintained at a pressure of 6 bar at 150° C. for 4 h. A further 100 ml of methanol are added, the mixture being maintained at the same pressure and temperature for 8 h.

After cooling, the cellulose acetate is precipated by the addition of acetone, then recovered by filtration and washing.

The degree of substitution and the molecular weight are determined by NMR analyis of the proton and gel permeation chromatography.

The cellulose acetate thus prepared has a degree of substitution of 0.55 and a molecular weight of 14,000. The product is soluble in water.

Examples 6–17 are formulation Examples. In each case, the "Polymer" specified is the material of Example 1.

Example 6

Spray-Dried Powder

| Component | % w/w |
|---|---|
| Na PAS | 11.5 |
| Dobanol 25-7 | 6.3 |
| Soap | 2.0 |
| Zeolite | 24.1 |
| SCMC | 0.6 |
| Na Citrate | 10.6 |

-continued

| Component | % w/w |
|---|---|
| Na Carbonate | 23.0 |
| Polymer | 0.3 |
| Silicone Oil | 0.5 |
| Dequest 2066 | 0.4 |
| Sokalan CP5 | 0.9 |
| Savinase 16 L | 0.7 |
| Lipolase | 0.1 |
| Perfume | 0.4 |
| Water/salts | to 100 |

Example 7

Detergent Granulate Prepared by Non-Spray Drying Method

The following composition was prepared by the two-stage mechanical granulation method described in EP-A-367 339.

| Component | % w/w |
|---|---|
| Na PAS | 13.5 |
| Dobanol 25-7 | 2.5 |
| STPP | 45.3 |
| Na Carbonate | 4.0 |
| Polymer | 0.28 |
| Na Silicate | 10.1 |
| Minors | 1.5 |
| Water | balance |

Example 8

Isotropic Laundry Liquid

| Component | % w/w |
|---|---|
| Na-citrate (37.5%) | 10.7 |
| Propyleneglycol | 7.5 |

-continued

| Component | % w/w |
|---|---|
| Ethylene Glycol | 4.5 |
| Borax | 3.0 |
| Savinase 16 L | 0.3 |
| Lipolase | 0.1 |
| Polymer | 0.25 |
| Monoethanolamine | 0.5 |
| Cocofatty acid | 1.7 |
| NaOH (50%) | 2.2 |
| LAS | 10.3 |
| Dobanol 25-7 | 6.3 |
| LES | 7.6 |
| Minors | 1.3 |
| (adjust pH to 7 with NaOH) | |
| Water | up to 100 |

Example 9

Structured Laundry Liquid

| Component | % w/w |
|---|---|
| LAS | 16.5 |
| Dobanol 25-7 | 9 |
| Oleic acid (Priolene 6907) | 4.5 |
| Zeolite | 15 |
| KOH, neutralisation of acids and pH to 8.5 | |
| Citric acid | 8.2 |
| deflocculating polymer | 1 |
| Protease | 0.38 |
| Lipolase | 0.2 |
| Polymer | 0.15 |
| Minors | 0.4 |
| Water | to 100% |

| | % w/w | | | | | | | |
|---|---|---|---|---|---|---|---|---|
| Component | Ex. 10 | Ex. 11 | Ex. 12 | Ex. 13 | Ex. 14 | Ex. 15 | Ex. 16 | Ex. 17 |
| Na alcohol EO sulphate | 0.0 | 0.0 | 0.0 | 0.0 | 0.0 | 0.0 | 0.0 | 13.3 |
| linear alkylbenzenesulfonate, Na salt (LAS) | 5.1 | 5.9 | 5.8 | 7.3 | 8.2 | 9.9 | 23.7 | 7.6 |
| sodium stearate | 0.0 | 0.3 | 0.3 | 0.3 | 1.0 | 1.2 | 0.0 | 0.0 |
| fatty acid | 1.7 | 0.3 | 0.3 | 0.4 | 0.0 | 0.0 | 0.0 | 0.0 |
| alcohol ethoxylate 9EO | 0.0 | 0.0 | 0.0 | 0.0 | 0.0 | 0.0 | 0.0 | 7.6 |
| alcohol ethoxylate 7EO branched | 2.5 | 3.9 | 3.9 | 4.8 | 4.3 | 5.2 | 0.0 | 0.0 |
| alcohol ethoxylate 3EO branched | 3.4 | 2.9 | 2.9 | 3.6 | 2.3 | 2.8 | 0.0 | 0.0 |
| sodium citrate | 0.0 | 0.0 | 0.0 | 0.0 | 3.3 | 7.4 | 0.0 | 4.8 |
| propylene glycol | 0.0 | 0.0 | 0.0 | 0.0 | 0.0 | 0.0 | 0.0 | 6.4 |
| sorbitol | 0.0 | 0.0 | 0.0 | 0.0 | 0.0 | 0.0 | 0.0 | 4.3 |
| sodium borate | 0.0 | 0.0 | 0.0 | 0.0 | 0.0 | 0.0 | 0.0 | 2.9 |
| sodium silicate | 0.4 | 5.9 | 5.8 | 7.3 | 1.5 | 0.0 | 7.9 | 0.0 |
| sodium carbonate | 17.6 | 9.0 | 12.0 | 12.4 | 9.2 | 17.5 | 17.3 | 0.0 |
| sodium bicarbonate | 0.0 | 0.0 | 0.0 | 6.1 | 0.9 | 3.8 | 0.0 | 0.0 |
| sodium sulphate | 19.8 | 16.2 | 13.9 | 16.3 | 0.0 | 0.0 | 26.1 | 0.0 |
| STPP | 0.0 | 22.1 | 22.1 | 27.4 | 0.0 | 0.0 | 14.3 | 0.0 |
| zeolite A24 (anhydrous) | 19.8 | 0.0 | 0.0 | 0.0 | 28.0 | 33.8 | 0.0 | 0.0 |
| sodium perborate tetrahydrate | 11.7 | 17.9 | 17.8 | 0.0 | 0.0 | 0.0 | 0.0 | 0.0 |
| coated percarbonate 13.5 avOx | 0.0 | 0.0 | 0.0 | 0.0 | 18.0 | 0.0 | 0.0 | 0.0 |
| TAED granule (83%) | 2.1 | 2.0 | 2.0 | 0.0 | 5.2 | 0.0 | 0.0 | 0.0 |
| minors | 5.9 | 3.8 | 3.2 | 4.2 | 8.0 | 8.3 | 0.8 | 1.2 |

-continued

| Component | % w/w | | | | | | | |
|---|---|---|---|---|---|---|---|---|
| | Ex. 10 | Ex. 11 | Ex. 12 | Ex. 13 | Ex. 14 | Ex. 15 | Ex. 16 | Ex. 17 |
| water | 0.0 | 0.0 | 0.0 | 0.0 | 0.0 | 0.0 | 0.0 | 46.9 |
| polymer | 10.0 | 10.0 | 10.0 | 10.0 | 10.0 | 10.0 | 10.0 | 5.0 |
| TOTAL: | 100.0 | 100.0 | 100.0 | 100.0 | 100.0 | 100.0 | 100.0 | 100.0 |

Raw Material Specification

| Component | Specification |
|---|---|
| LAS | Linear Alkyl Benzene Sulphonic-acid, Marlon AS3, ex Huls |
| Na-LAS | LAS-acid neutralised with NaOH |
| Dobanol 25-7 | C12–15 ethoxylated alcohol, 7EO, ex Shell |
| LES | Lauryl Ether Sulphate, Dobanol 25-S3, ex Shell |
| Zeolite | Wessalith P, ex Degussa |
| STPP | Sodium Tri PolyPhosphate, Thermphos NW, ex Hoechst |
| Dequest 2066 | Metal chelating agent, ex Monsanto |
| Silicone oil | Antifoam, DB 100, ex Dow Corning |
| Tinopal CBS-X | Fluorescer, ex Ciba-Geigy |
| Lipolase | Type 100 L, ex Novo |
| Savinase 16 L | Protease, ex Novo |
| Sokalan CP5 | Acrylic/Meleic Builder Polymer ex BASF |
| Deflocculating Polymer | Polymer A-11 disclosed in EP-A-346 995 |
| SCMC | Sodium Carboxymethyl Cellulose |
| Minors | antiredeposition polymers, transition-metal scavangers/bleach stabilisers, fluorescers, antifoams, dye-transfer-inhibition polymers, enzymes, and perfume. |

Examples 18–24

Performance Evaluation

The aim of the following experiment was again to determine the build-up of cellulose acetate on cotton fabric by measuring the change in weight of pieces of cotton fabric over successive 30 minute, 40° C. washes in surfactant-containing, buffered liquors with (and without) various water soluble cellulose acetate samples. A rigorous drying procedure was adopted to measure "dry" weight changes due only to the mass of cellulose acetate built up on the fabric.

Method

The cotton fabric used was mercerised, bleached, woven, not dyed and previously desized by washing in 1 g/l Synperonic A7+4.5 g/l sodium carbonate at 95° C. followed by rinsing in de-ionised water at 95° C. The fabric was cut up into 22 cm×22 cm squares. Threads running parallel to the edges were removed to a depth of 1 cm, in an attempt to prevent the loss of threads during the washes. The weight of each square was ~7 g and each cloth was to be washed separately. Therefore 70 ml of liquor gave a liquor cloth ratio of ~10:1.

For deposition at pH ≈10.5 the final wash liquor contained 0.01M carbonate buffer (0.00712 M $Na_2CO_3$ and 0.00288 M $NaHCO_3$) while for deposition at pH ≈7 the liquor contained 0.01 M phosphate buffer (0.005 M $Na_2HPO_4$+0.005 M $NaH_2PO_4$). All wash liquors contained 1 g/l of 50:50 wt % LAS:A7.

All cloths were "pre-washed" in the appropriate buffer before measuring weights at "Wash no.=0", with surfactant, but without any celullose acetate, at 40° C. and for 30 minutes.

Three rinses were then performed. After rinsing the cloths were squeezed out and hung in the test room at 20° C. and 65% humidity for 24 hours to dry and equilibrate. After 24 hours the cloths were weighed at constant temperature and humidity in the same room, in order to obtain the "acclimatised from wet" weight at "wash zero" defined as after the pre-wash but before any washes with cellulose acetate.

The acclimatised cloths were placed individually in jars. The jars were then placed in a Gallenkamp vacuum oven. The cloths were heated under vacuum at 85° C. for 15 hours. After this the oven was vented with air, and the jars were removed from the oven and quickly closed with lids. The jars were allowed to cool for one hour, the lids were momentarily loosened to relieve any partial vacuum, and the jars weighed. The weight of the vacuum-dried cloth was calculated by difference.

After weighing the cloths were placed on the drying rack at 20° C. and 65% humidity and left to acclimatise for 24 hours before being weighed again under these standard conditions.

This concluded the pre-wash (Wash 0) and the cloths were then ready for their first wash (Wash 1) in cellulose monoacetate (except for the no-cellulose-acetate standard).

The cloths were washed for 30 minutes at 40° C. for a total of 15 times. The cloths were rinsed after every wash as described above. The cloths were weighed after acclimatising from wet, vacuum drying, and acclimatised from dry, as described above. After all other washes the cloths were line-dried in normal laboratory conditions after each wash.

The percentage by weight absorption of the monoacetate material was measured for samples with varying $M_w$ and degree of substitution.

Results

| Example | 18 | 19 | 20 | 21 | 22 | 23 |
|---|---|---|---|---|---|---|
| $M_w$ | 10,000 | 10,000 | 10,000 | 14,000 | 14,000 | 30,000 |
| DS | 0.50 | 0.58 | 0.65 | 0.61 | 0.70 | 0.95 |
| % absorption | 71.7 | 98.6 | 98.6 | 98.0 | 87.7 | 74.6 |

DS = degree of substitution

Example 24

Washing and Treatment

Three samples 0.40 m×0.80 m numbered (1) to (3) and three reference samples 0.40 m×0.80 m lettered (A) to (C) of new cotton CN1 (CFT) were used.

The contours of each sample were measured precisely. Samples (1) to (3) were subjected to the following washing operations:

| WASH W1 | |
|---|---|
| Powdered detergent formulation | |
| anionic surfactants | 6 parts |
| non-ionic surfactants | 12 parts |
| $Na_2CO_3$ | 15 parts |
| 2 $SiO_2$, $Na_2O$ | 5 parts |
| zeolite 4A | 25 parts |
| sodium sulphate | 10.7 parts |
| Sokalan CP5 (BASF) | 5 parts |
| sodium perborate, 1 $H_2O$ | 15 parts |
| TAED | 5 parts |
| water | 1.3 parts |
| enzyme (Esperase 6T by Novo) | 0.3 part |

Equipment

Automatic washing machine LAVAMAT 2050 TURBO AEG

Washing Machine Load samples (1) to (3)+5 white terry towels 56 g of formulation (for 11.2 liters of washing water, i.e. 5 g/l)

Washing Conditions temperature: 80° C.

4 rinses/spins

Washing/Treatment W/T

| Powdered detergent formulation | |
|---|---|
| anionic surfactants | 6 parts |
| non-ionic surfactants | 12 parts |
| $Na_2CO_3$ | 15 parts |
| 2 $SiO_2$, $Na_2O$ | 5 parts |
| zeolite 4A | 25 parts |
| sodium sulphate | 10.7 parts |
| Sokalan CP5 (BASF) | 5 parts |
| sodium perborate, 1 $H_2O$ | 15 parts |
| TAED | 5 parts |
| water | 1.3 parts |
| enzyme (Esperase 6T by Novo) | 0.3 part |

57.5 g of this formulation were supplemented by 1.2 g of the cellulose acetate of example 5, and 10.4 g of sodium carbonate Equipment Washing machine of the same type as above, but non-automatic.

Washing Machine Load samples (1) to (3) (spun damp)+1 piece of 80 cm×85 cm untreated polyester cotton+1 piece of 65 cm×110 cm untreated polyester (Dacron)

69.1 g of supplemented formulation (for 11.5 liters of washing water).

Washing Conditions temperature: 40° C.

delicate laundry programme/3 rinses/spinning at 800 rpm for 2 mins.

At the end of the washing/treatment operation W/T, the sample (1) was removed and subsequently dried in an AEG LAVATHERM 550 dryer.

Wash W2

Samples (2) and (3) (spun damp) from the WASHING/TREATMENT W/T operation were subjected to a WASH W2 operation under conditions identical to those of WASH W1.

The sample (2) was then removed and subsequently dried in the AEG LAVATHERM 550 dryer.

WASH W3–7

Sample (3) (spun damp) from the WASH W2 operation was then subjected to 5 washing cycles under conditions identical to those of WASH W1 without drying between the cycles. Sample (3) was then removed and subsequently dried in the AEG LAVATHERM 550 dryer. Reference samples (A) to (C) were subjected to the WASH W1, WASH W2 and WASH W3–7 operations without a drying cycle between the operations (therefore they were not subjected to WASHING/TREATMENT W/T). After the WASH:

W1, sample (A) was removed for subsequent drying

W2, sample (B) was removed for subsequent drying

W3–7, sample (B) was removed for subsequent drying

Samples (1) to (3) and (A) to (C) are then dried in the AEG LAVATHERM 550 dryer.

Wear

The property of protecting the textile fibres, imparted by the presence of cellulose acetate and a de-esterifying additive in a washing medium, was demonstrated by means of a wear test by measuring the breaking pressure (E) of fabric samples according to standard NF-G-07 112 using an Eclatometer EC.07 made by ADAMEL LHOMARGY. The principle was to subject a fabric sample to a pressure uniformly distributed over a specified area thereof and to measure the breaking pressure. After drying, the contours of each sample were measured. The shrinkage coefficient (R) of the samples in the wash were thus determined. The "wear pressure" is defined by the equation U in kPa=(R)×(E). The results obtained are given in table 1.

TABLE 1

| | Sample | | |
|---|---|---|---|
| | (1) (W1 + W/T) | (2) (W1 + W/T + W2) | (3) (W1 + W/T + W2 + W3–7) |
| R | 0.852 | 0.851 | 0.835 |
| E (kPa) | 940.3 | 933.2 | 919.8 |
| U (kPa) | 801.1 | 794.2 | 768.0 |

| | Sample | | |
|---|---|---|---|
| | (A) W1 | (B) W1 + W2 | (C) W1 + W2 + W3–7 |
| R | 0.851 | 0.848 | 0.831 |
| E (kPa) | 915.5 | 910.0 | 907.5 |
| U (kPa) | 779.1 | 771.7 | 754.1 |

What is claimed is:

1. A laundry treatment composition comprising a water-soluble or water-dispersible rebuild agent for deposition onto a fabric during a treatment process wherein the rebuild agent undergoes, during the treatment process, a chemical change by which change the affinity of the rebuild agent for the fabric is increased, said chemical change resulting in the loss or modification of one or more groups covalently bonded to be pendant to a polymeric backbone of the rebuild agent via an ester linkage, the ester-linkage group(s) being selected from one or more materials of general formula (I):

(I)

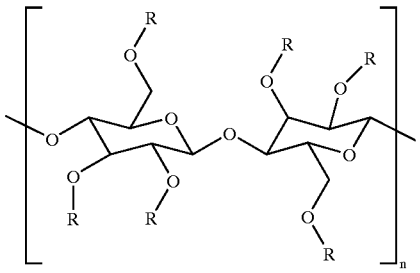

wherein at least one or more R groups of the polymer are independently selected from groups of formulae:

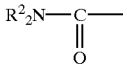

wherein each $R^2$ is independently selected from hydrogen $C_{1-20}$ alkyl, $C_{2-20}$ alkenyl and $C_{5-7}$ aryl; unsubstituted or substituted by one or more substituents independently selected from $C_{1-4}$ alkyl, $C_{1-12}$ alkoxy, hydroxyl, vinyl and phenyl groups; and n is an integer selected so that the weight average molecular weight of the rebuild agent is in the range of about 500 to $2\times10^6$.

2. The laundry treatment composition of claim 1 wherein the rebuild agent has an $R^2$ group independently selected from $C_{1-6}$ alkyl, $C_{2-6}$ alkenyl, vinyl, and phenyl; unsubstituted or substituted by one or more substituents independently selected from $C_{1-4}$ alkyl, $C_{1-4}$ alkoxy, hydroxyl, vinyl, and phenyl groups.

3. The composition of claim 1 wherein the polymeric backbone comprises cellulose units or other β-1,4 linked polysaccharide units.

4. The composition of claim 3 wherein the polymeric backbone comprises cellulose units or other β-1,4 linked polysaccharide units.

5. The composition of claim 4, wherein the average degree of substitution of the total of all groups on the saccharide rings is from 0.4 to 3.

6. The composition of claim 4, wherein the average degree of substitution of the total of all groups on the saccharide ring s is from 0.4 to 1.

7. The composition of claim 4 wherein the average degree of substitution of the total of all groups on the saccharide rings is from 0.5 to 0.75.

8. The composition of claim 4, wherein the average degree of substitution of the total of all groups on the saccharide rings is from 0.6 to 0.7.

9. The composition of claim 1, wherein up to 65% of the total number of pendant are groups other than those which undergo the chemical change.

10. The composition of claim 1, wherein up to 10% of the total number of pendant are groups other than those which undergo the chemical change.

11. The composition of claim 10, wherein up to 20% of the total number of the other groups are water-solubilising groups.

12. The composition of claim 10, wherein up to 10% of the total number of the other groups are water-solubilising groups.

13. The composition of claim 10, wherein up to 5% of the total number of the other groups are water-solubilising groups.

14. The composition of claim 9, wherein up to 20% of the total number of other groups are water-solubilising groups.

15. The composition of claim 9, wherein up to 10% of the total number of other groups are water-solubilising groups.

16. The composition of claim 9, wherein up to 5% of the total number of other groups are water-solubilising groups.

17. The composition of claim 1, which further comprises a surfactant.

18. The composition of claim 1, comprising from 0.005% to 25% by weight of the rebuild agent.

19. The composition of claim 1, comprising from 0.01% to 10% by weight of the rebuild agent.

20. The composition of claim 1, comprising from 0.025% to 2.5% by weight of the rebuild agent.

21. The composition of claim 1, further comprising at least one water-soluble additive capable of assisting or inducing in the wash and/or rinse liquor, deposition of the rebuild agent onto the fabric.

22. The composition of claim 21, wherein the water-soluble additive is selected from the additives which, in the washing or rinsing liquor, have an anion capable of decomposing and a cation capable of forming a soluble salt with the anion originating from the substituent or substituents.

23. The composition of claim 21, wherein the water-soluble additive is an alkali metal salt selected from a carbonate, hydrogen carbonate, oxalate, and tartrate.

24. The composition of claim 21, wherein the alkali metal is sodium.

25. The composition of claim 21, wherein the amount of alkaline water-soluble additive is at least 5 times the stoichiometric amount necessary for complete chemical change to enable deposition of the rebuild agent.

26. The composition of claim 21, wherein the amount of alkaline water-soluble additive is at least 10 times the stoichiometric amount necessary for complete chemical change to enable deposition of the rebuild agent.

27. A method of rebuilding a fabric to replace fibre loss due to washing, the process comprising:

(a) preparing a liquor comprising composition according to claim 1, and (b) treating the fabric with said liquor.

28. A laundry treatment composition comprising a water-soluble or water dispersible rebuild agent for deposition onto a fabric during a treatment process wherein the rebuild agent undergoes the treatment process, a chemical change by which change the affinity of the rebuild agent for the fabric is increased, the chemical change occurring in or to a group or groups covalently bonded to be pendant on a polymeric backbone of the rebuild agent and which backbone comprises cellulose units or other, β-1,4 linked polysaccharide units, the average degree of substitution of the total of all groups pendant on the saccharide rings of the backbone being from 0.3 to 3, wherein at least one or more of the groups are selected from:

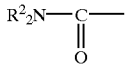

wherein each $R^2$ is independently selected from hydrogen, $C_{1-20}$ alkyl, $C_{2-20}$ alkenyl and $C_{5-7}$ aryl; unsubstituted or substituted by one or more substituents independently selected from $C_{1-4}$ alkyl, $C_{1-12}$ alkoxy, hydroxyl, vinyl and phenyl groups.

29. The laundry treatment composition of claim 28, wherein the average degree of substitution of the total of all groups pendant on the saccharide rings of the backbone of the rebuild agent is from 0.4 to 1.

30. The laundry treatment composition of claim 28, wherein the average degree of substitution of the total of all groups pendant on the saccharide rings of the backbone of the rebuild agent is from 0.5 to 0.75.

31. The laundry treatment composition of claim 28, wherein the average degree of substitution of the total of all groups pendant on the saccharide rings of the backbone of the rebuild agent is from 0.6 to 0.7.

32. The laundry treatment composition of claim 31, wherein the rebuild agent has an $R^2$ group independently selected from $C_{1-6}$ alkyl, $C_{2-6}$ alkenyl, vinyl, and phenyl; unsubstituted or substituted by one or more substituents independently selected from $C_{1-6}$ alkyl, $C_{2-6}$ alkoxyl, hydroxyl, vinyl, and phenyl groups.

33. The composition of claim 28, wherein the chemical change if hydrolysis perhydrolysis or bond-leavage, optionally catalyzed by an enzyme or another catalyst.

34. The composition of claim 28, wherein the chemical change is other than protonation or deprotonation.

35. The composition of claim 28, wherein the rebuild agent is selected from one or more molecules of formula (II):

(II)

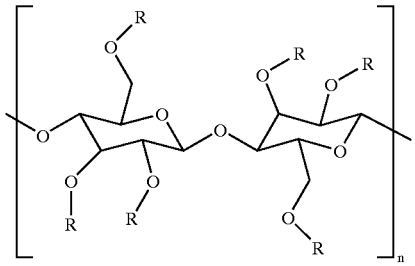

wherein at least one or more R groups of the polymer are independently selected from groups of formulae:

wherein each $R^2$ is independently selected from $C_{1-20}$ alkyl, $C_{2-20}$ alkenyl, and $C_{5-7}$ aryl;

unsubstituted or substituted by one or more substituents independently selected from $C_{1-4}$ alkyl, $C_{1-12}$ alkoxy, hydroxyl, vinyl and phenyl groups.

36. The composition of claim 28, wherein at least some of the groups which undergo the chemical change are independently selected from one or more methanesulphonate and toluene sulphonate groups and hemiester groups of fumaric, malonic, itaconic, oxalic, maleic, succinic, tartaric, glutamic, aspartic and malic acids.

37. The composition of claim 28, wherein up to 65% of the total number of pendant are groups other than those which undergo the chemical change.

38. The composition of claim 28, wherein up to 10% of the total number of pendant are groups other than those which undergo the chemical change.

39. The composition of claim 28, which further comprises a surfactant.

40. The composition of claim 28, comprising from 0.005% to 25% by weight of the rebuild agent.

41. The composition of claim 28, comprising from 0.01% to 10% by weight of the rebuild agent.

42. The composition of claim 28, comprising from 0.025% to 2.5% by weight of the rebuild agent.

43. A method of rebuilding a fabric to replace fibre loss due to washing, the process comprising:

(a) preparing a liquor comprising composition according to claim 28, and (b) treating the fabric with said liquor.

* * * * *

UNITED STATES PATENT AND TRADEMARK OFFICE

CERTIFICATE OF CORRECTION

PATENT NO. : 6,506,220 B2
DATED : January 14, 2003
INVENTOR(S) : Clark et al.

It is certified that error appears in the above-identified patent and that said Letters Patent is hereby corrected as shown below:

Column 16,
Line 58, which reads:
"It is often advantageous if soil release or soil suspendng" should read
-- It is often advantageous if soil release or soil suspending --

Column 28,
Line 42, which reads:
"undergoes the treatment process, a chemical change by" should read
-- undergoes, during the treatment process, a chemical change by --

Column 29,
Between lines 33 and 34, please insert missing formula:

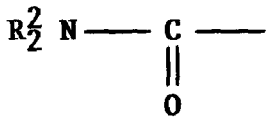

Column 30,
Line 2, which reads:
"independently selected from $C_{1-14}$ alkyl, $C_{1-12}$ alkoxy," should read
-- independently selected from hydrogen, $C_{1-14}$ alkyl, $C_{1-12}$ alkoxy, --

Signed and Sealed this

Third Day of June, 2003

JAMES E. ROGAN
*Director of the United States Patent and Trademark Office*